United States Patent [19]

Curtiss

[11] 4,058,130

[45] Nov. 15, 1977

[54] PIPE-CIGARET

[76] Inventor: George C. Curtiss, 832 NE. 124th St., North Miami, Fla. 33161

[21] Appl. No.: 632,731

[22] Filed: Jan. 8, 1976

[51] Int. Cl.[2] ..... A24F 13/06; A24F 1/22

[52] U.S. Cl. ..... 131/192; 131/194; 131/196; 131/202

[58] Field of Search ..... 131/172, 192, 3, 170 R, 131/171 R, 175, 176, 178, 183, 196, 194, 16, 204

[56] References Cited

U.S. PATENT DOCUMENTS

| | | | |
|---|---|---|---|
| 223,630 | 1/1880 | Bacon | 131/196 |
| 711,691 | 10/1902 | Barger | 131/16 X |
| 2,373,296 | 4/1945 | Donnelly | 131/204 |
| 3,902,505 | 9/1975 | Carleton | 131/172 |

*Primary Examiner*—Robert W. Michell
*Assistant Examiner*—V. Millin
*Attorney, Agent, or Firm*—Ernest H. Schmidt

[57] ABSTRACT

A Pipe-cigaret constructed according to the present invention consists of a T-shaped single sheet of flexible material having a shorter section of a substantially rectangular shape and an elongated section of a substantially rectangular shape extending from a center edge thereof, said single sheet formed with panels folded to form a bowl for containing tobacco and a tubular stem for drawing smoke to an opposite free tip thereof, and said bowl provided with a fire proof corrugated inner lining for being insulated and protected from lighted tobacco therein and for providing a cooler smoke.

11 Claims, 6 Drawing Figures

PIPE-CIGARET

This invention relates to a disposable tobacco smoking device and more particularly to a pipe-like cigaret which causes smoking of pure tobacco only thereby eliminating any ill effects and bad tasting from smoking tobacco with burning cigaret rolling paper.

BACKGROUND OF THE INVENTION

One of the drawbacks of cigaret smoking is the smoking of paper rolled tobacco which causes the smoke from the burning paper to be inhaled as well as that of the tobacco, thereby affecting not only the taste thereof but also producing ill effects to the health of the smoker, and which effects are practically eliminated by pipe smoking but not everybody desires or is accustomed to pipe smoking.

SUMMARY OF THE INVENTION

The primary object of this invention is to provide a disposable pipe-like cigaret which is made of flexible or paper material and which combines the pure tobacco smoking of a pipe with that of a cigaret thus eliminating inhaling of the unpleasant smoke of the cigaret tobacco paper wrapper and, therefore, the noxious and health hazardous effect resulting therefrom.

A further object of the present invention is to provide a pipe-cigaret which provides a relatively pure clean taste of aromatic pipe-like tobacco smoking and which has a relatively long filter in the stem thereof substantially reducing the nicotine and tar content of the tobacco and, therefore, improving the health protection qualities of cigaret smoking.

A pipe-cigaret constructed according to the present invention may be laid or placed anywhere without danger of causing a fire by igniting the surroundings or by spilling lighted tobacco thereon, and will cause the tobacco to burn completely without possible spilling over which may cause an accidental starting of a fire.

Furthermore the pipe-cigaret of the present invention produces a relatively cooler smoke which is less hazardous to health and absorbs most of health hazardous material usually inhaled by a smoker, and may be available either without being filled with tobacco, as a pipe-like, or filled with tobacco, as a cigaret-like.

DESCRIPTION OF THE PREFERRED EMBODIMENT

Figure 1:
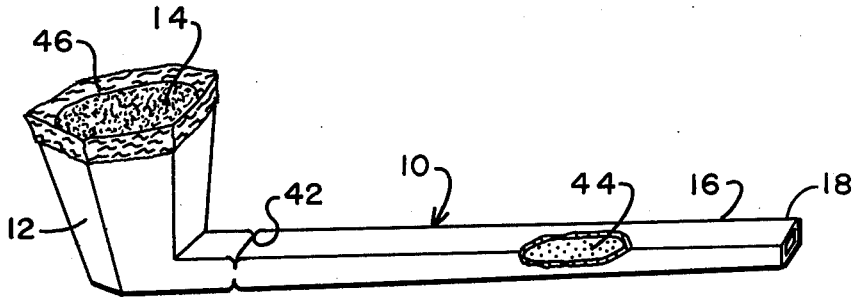
FIG. 1 is a perspective view of pipe-cigaret constructed in accordance with the present invention.

Referring now to the drawing in detail, the embodiment of the invention here illustrated is designated in general by numeral 10 and comprises a bowl or receptacle 12 which may be filled with tobacco 14 and an elongated tubular stem 16 extending substantially at a right angle thereto and in communication therewith for drawing smoke from lighted tobacco 14 at an opposite free end tip 18, as showh in FIG. 1.

The bowl 12 and the stem 16 of the pipe-cigaret 10 are formed as one unit from a T-shaped single or one piece sheet of flexible material designated in general by numeral 20, such as paper, which has a certain flexibility but also has sufficient rigidity for preventing it from buckling at moderate pressures usually applied thereon from merely holding it for smoking.

Figure 3:
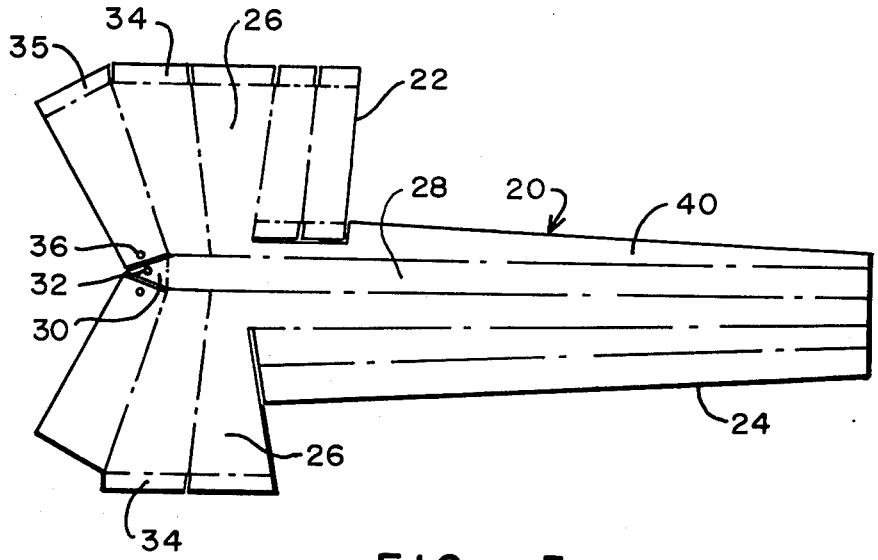
FIG. 3 is a top plan view of the single sheet of flexible material of FIG. 2 without the inner lining being shown.
Figure 4:
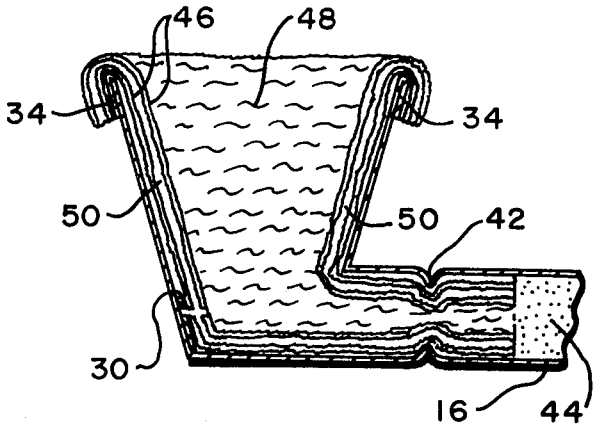
FIG. 4 is a side elevational sectional view of the pipe-cigaret of FIG. 1 showing a cutaway view of the bowl and stem.
Figure 5:
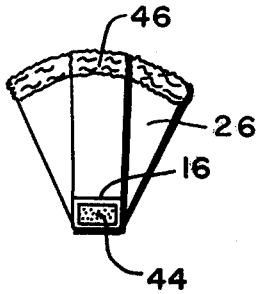
FIG. 5 is an end elevational view of the pipe-cigaret of FIG. 1, showing the stem thereof.
Figure 6:
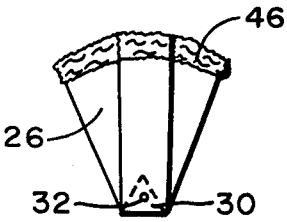
FIG. 6 is an end elevational view of the pipe-cigaret of FIG. 1, showing the bowl thereof.

Laid out flat, as best shown in FIG. 3, the single sheet 20 is formed with a shorter section 22 of a substantially rectangular shape adapted to be folded to form the bowl 12 and an elongated or longer section 24 of a substantially rectangular shape adapted to be folded to form the stem 16. The section 22 is further formed with foldable panels 26 extending laterally from a center bottom panel 28. The panel 28 is formed with a triangularly shaped flap 30 foldable against the panels 26 and provided with a pinhole or perforation 32 for permitting air to pass through. The panels 26 are also formed edge flaps 34 adapted to be folded over on the outside thereof thereby reinforcing the upper free edge 35 of the bowl 12.

The panels 26 adapted to be folded to form the bowl 12 are fastened to each other at the end panels thereby forming a permanent and sturdy structure. The triangular flap 30 is secured or fastened to the abutting panels 26 at the inner side thereof, as by glue. The rear end ones of the panels 26 are each formed with a pinhole or perforation 36 adapted to be aligned with the pinhole 32 of the panel 30 abutting and fastened to the panels 26. The outer ones of panels 26 are further of a substantially rectangular shape while the center ones are of a substantially triangular shape for forming slanted sides 38. The bowl 12 being formed with a wider upper opening for being filled with a charge of tobacco is also formed with a hexagonal or multiple side shape for permitting air to pass through, especially, at the corners between the sides 38 where the tobacco is loosely packed and thereby providing a cooler smoke.

The elongated section 24 is also formed with foldable panels 40 extending longitudinally or the full length thereof, in parallel relation to each other, and, are adapted to be folded for forming the tubular stem 16. The end panel of the panels 40 of the stem 16 is adapted to be folded over the underlying panel to which may be fastened, as by glue, not shown, thereby forming a permanent structure. The center panel 28 which extends the full length of the bowl shorter section 22 and of the stem longer section 24 forms the bottom panel of the pipe-cigaret 10.

The stem 16 is further formed with a depression or crimp 42 in the upper and lower sides thereof, respectively.

The depressions 42 provide an inner cross-section of a reduced area thereby causing smoke and air to travel faster therethrough and, therefore, facilitating drawing and cooling of the smoke. Furthermore, a filter 44 positioned in the stem 16 extends from the free end tip 18 to adjacent the depression 42 and is adapted to filter the smoke passing through the stem 16. In view of the relatively longer length, the filter 44 provides a greater filtering area and therefore is expected to eliminate more nicotine and harmful tars than usual.

Figure 2:
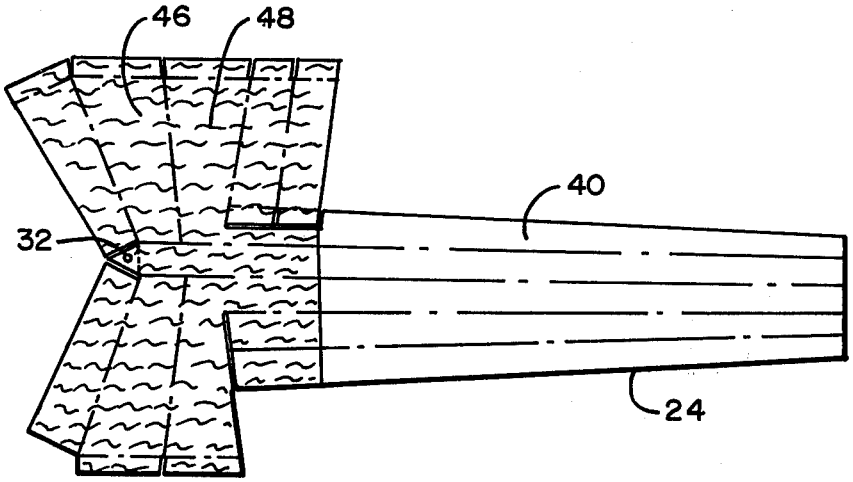
FIG. 2 is a top plan view of an unfolded single sheet of flexible material with a fire proof lining laid thereon of the pipe-cigaret of FIG. 1.

To prevent the paper material of the bowl 12 from being ignited or burned by the lighted tobacco, an inner lining 46 of at least one sheet or ply of fire proof material, such as aluminum foil, is fastened, as by glue, to the sheet 20. The inner lining 46 has a shape substantially of that of the shorter section 22 which is completely covered thereby, as shown in FIG. 2. The inner lining 46, also, extends for a short length into the stem 16 just past the depression or crimp 42 for preventing the paper material 20 from being ignited by lighted tobacco, which may reach as far as or adjacent to the filter 44 in the stem 16.

The inner lining 46, which preferably consists of two sheets or layers of the fire material, as illustrated herein, is adapted to be folded over the top peripheral edge 35, of the bowl 12 and to cover the flaps 34 to which it is attached or fastened. The inner lining 46 being corrugated or wrinkled, as indicated at 48, forms air pockets and passages 50 between each other and the paper material of the bowl 12 thus keeping the paper walls of the bowl 12 further insulated and cooler to the human touch and also providing cooler smoking.

The preferred embodiment of the present invention has been described in the foregoing specifications, however, it should be understood that the invention intended to be protected herein is not limited by that which is shown in the drawing and described in the specification, but only as defined in the appended claims.

What I claim is:

1. A pipe-cigaret comprising a substantially T-shaped single sheet of flexible material having an elongated section of a substantially rectangular shape and a shorter and wider section of a substantially rectangular shape extending laterally from an edge at one end thereof, said elongated section having panels foldable and extending the length thereof to form a tubular stem for drawing smoke therethrough to a free tip at the other end thereof, and said shorter section having panels foldable to form a bowl for filling with tobacco.

2. The pipe-cigaret of claim 1 in which said shorter section of flexible material being provided with a covering sheet of flexible metallic material to form a protective surface thereon.

3. The pipe-cigaret of claim 1 in which a one-piece sheet of flexible fire proof material being positioned on said shorter section for providing a protective lining thereon.

4. The pipe-cigaret of claim 3 in which said sheet of flexible fire proof material being fastened to said shorter section thereby forming a two-ply sheet.

5. The pipe-cigaret of claim 3, including a second sheet of flexible fire proof material fitted over said one-piece sheet, both sheets being corrugated to form a plurality of air pockets therebetween for cooler smoke.

6. The pipe-cigaret of claim 3 in which said bowl and said inner lining sheet being formed with air passages therebetween for permitting air to pass therethrough for cool smoking.

7. The pipe-cigaret of claim 3 in which said inner lining being formed witn wrinkles and folds for providing air passages therebetween thereby cooling the smoke being drawn from the lighted tobacco.

8. The pipe-cigaret of claim 1 in which said elongated stem having a filter for causing substantially all smoke drawn to the opposite free tip from lighted tobacco in said bowl to pass therethrough.

9. The pipe-cigaret of claim 1 in which said substantially T-shaped single sheet of flexible material and said one piece sheet of flexible fire proof material being formed with edge flaps for folding thereover thereby reinforcing the edges of said sheets.

10. The pipe-cigaret of claim 1 in which said substantially T-shaped single sheet of flexible material having one of said panels beng perforated for permitting passages of air into said bowl thereby facilitating the drawing of smoke therefrom.

11. The pipe-cigaret of claim 1 in which said shorter section panels folded form a bowl having a substantial hexagonal shape, said plurality of shorter panels being provided with pinholes which, upon the folding of said section panels align with one another to provide a through opening substantially coaxial with said tubular stem for causing air to pass through tobacco in said bow for a cooler smoke.

* * * * *